United States Patent [19]

Smejkal et al.

[11] 4,107,973

[45] Aug. 22, 1978

[54] PRESS DRIVE MECHANISM

[75] Inventors: Paul V. Smejkal, Berwyn; Robert B. Baranski, Chicago, both of Ill.

[73] Assignee: Gulf & Western Manufacturing Company, Southfield, Mich.

[21] Appl. No.: 821,331

[22] Filed: Aug. 4, 1977

[51] Int. Cl.[2] ..... B21J 9/18

[52] U.S. Cl. ..... 72/450

[58] Field of Search ..... 72/450, 429; 100/282

[56] References Cited

U.S. PATENT DOCUMENTS 3,052,200 9/1962 Dehn ..... 100/282

FOREIGN PATENT DOCUMENTS 587,093 11/1959 Canada ..... 72/452
1,029,957 3/1953 France ..... 100/283
43,075 12/1971 Japan ..... 100/283
2,458,489 12/1975 Fed. Rep. of Germany ..... 72/450
1,433,112 4/1976 United Kingdom ..... 100/282

*Primary Examiner*—C.W. Lanham
*Assistant Examiner*—Gene P. Crosby
*Attorney, Agent, or Firm*—Meyer, Tilberry & Body

[57] ABSTRACT

A press drive mechanism is disclosed which is comprised of a drive shaft having a first eccentric which receives a power link member. The power link member has an end connected to the press slide by means of a connecting link, and the power link member also includes a second eccentric having an axis parallel to and offset from both the drive shaft and first eccentric axes. A rocker link member is received on the second eccentric and has an end pivotally connected to the press frame. The rocker link constrains oscillating movement of the power link member in response to rotation of the drive shaft, thus to control the displacement and velocity characteristics of the reciprocating movement imparted to the press slide.

33 Claims, 7 Drawing Figures

PRESS DRIVE MECHANISM

This invention relates to the art of presses and, more particularly, to an improved drive mechanism for reciprocating a press slide.

Many structural arrangements and designs have been devised heretofore in an effort to improve the displacement and velocity characteristics of a crank driven press slide. Basically, in the latter type of press drive the slide is reciprocated by means of a crank member interconnected with the press slide through a connecting link. Accordingly, rotation of the crank at a constant speed imparts reciprocating movement to the slide with generally uniform velocity and displacement characteristics which, graphically, are generally sinusodial. Work is performed on a workpiece between the press slide and bed during a portion of the total stroke of the slide known as the work stroke, and the quality of the work performed is dependent in part on the velocity of the slide through the work stroke. Thus, it will be appreciated that the press must be run at a slide stroke rate which provides the velocity through the work stroke necessary to achieve a desired work quality. With a basic crank driven slide arrangement, return and approach velocities of the slide with respect to a desired velocity through the work portion of the total stroke of the slide are relatively slow and often require operation of the press at less than the rated strokes per minute at which the press is capable of operating. This results in a less than desirable production rate for the press, and any effort to increase the production rate by increasing the stroke rate of course results in undesirable work quality. A desirable characteristic in connection with such a crank-type drive arrangement is the location of the crank shaft in the crown of the press above and generally in alignment with the slide path enabling simplicity and economy with regard to crown design. However, the basic crank-type drive has an undesirably low work stroke to total stroke ratio, and does not have a desirable mechanical advantage with respect to the transmission of forces through the drive mechanism to the slide. These drawbacks result in poor distribution of mass, poor force distribution during operation and high acceleration forces.

Several structural arrangements and designs have been devised heretofore in an effort to improve upon the velocity and displacement characteristics of the basic crank-type press drive and in an effort to improve upon the work stroke to total stroke ratio and/or the mechanical advantage for force transmission. A common mechanism among the previous efforts includes an eccentric drive shaft carrying a power link which is connected to the slide by a connecting link. The power link is pin connected to a rocker link at an axis on one side of the drive shaft axis and is pin connected to the press frame at an axis on the same side and below the drive shaft axis. In response to rotation of the eccentric shaft, the power link oscillates relative to the eccentric and the motion thereof is constrained by the rocker link to control the displacement and velocity characteristics of the slide. This drive mechanism produces a motion which results in a reduced slide velocity in the work stroke and a higher velocity during the return and advance movements of the slide following and preceding the work stroke. However, previous structural arrangements of this character provide very little mechanical advantages as compared to a basic crank-type drive, and require an eccentric throw equal to or greater than one-third the total press stroke. The mechanism is move complex structurally than the basic crank-type drive, more massive, and is considerably more expensive to manufacture. Accordingly, it affords basically the sole advantage of enabling the press to be operated at a faster stroke rate than a crank-type press of equal stroke length by providing a reduced velocity during the work stroke portion of the total stroke.

Another drive arrangement heretofore provided in an effort to improve the characteristics of a basic crank-type drive utilizes a crankshaft laterally offset a considerable distance from the slide path and having a crank arm pivotally connected to a drag link which extends toward the slide path. The drag link and slide are interconnected by means of a connecting link pinned to the drag link and to the slide. A rocker or constraining link is pivotally connected to the drag link and to the press frame. This mechanism has a mechanical advantage of up to 5:1 over a baskc crank-type arrangement and also produces a desired reduced velocity in the work stroke portion of the total stroke of the slide. However, the arrangement requires structurally massive linkage and a complex and unconventional crown designed to accommodate the offset crankshaft and linkage components. For example, the crankshaft has a throw of approximately 0.7 times the slide stroke produced, and the drag link which is the most massive of the several links is subjected to bending forces nearly equal to the press tonage and to accelerating forces far in excess of those of a basic crank-type drive mechanism. Accordingly, the press is extremely bulky and expensive to manufacture and maintain, and it is impractical to apply this drive arrangement to presses having long strokes or to multiple point presses.

In accordance with the present invention, an improved press drive mechanism is provided which enables obtaining the desired velocity and displacement characteristics for a press slide without the disadvantages encountered in connection with previous press drives including those enumerated hereinabove. More particularly, a press drive in accordance with the present invention utilizes a unique crankshaft, power link rocker, rocker link connecting link design which enables achieving a desired slow down of the slide during the work stroke portion of the total stroke and an increased velocity during the return and approach portion of the stroke. Furthermore, overall linkage arrangements according to the present invention are smaller physically than those of previous mechanisms, and enable increasing a given stroke length with very little increase in linkage size. Moreover, compared to previous mechanisms, they enable the use of a more conventional crown design, reducing the mass for the drive mechanism at the point of connection with the connecting link, and reducing the mass for the connecting link itself.

With regard to the length of the stroke of the slide and the size of the component parts heretofore required to obtain a given stroke length, the mechanism of the present invention for example enables use of a crankshaft or an eccentric throw which is less than one-fifth of the length of the slide stroke. In comparison, as mentioned hereinabove, previous mechanisms required an eccentric or crankshaft throw equal to at least one-third the press stroke and in crank-type drives equal to or greater than one-half the press stroke. Structural drive arrangements according to the present invention further provide for the application of minimal acceleration forces between the power link and connecting link and between the power link and rocker link, the application of minimal bending loads to the link components, and better distribution of forces to the press frame. The linkage arrangement is lighter in weight than previously used mechanisms, is significantly more economical to manufacture and maintain, and enables obtaining a longer work stroke for a given total stroke than can be obtained with a crank drive arrangement.

Basically, a drive mechanism in accordance with the present invention includes an eccentric shaft, a power link received thereon and oscillated in response to rotation thereof, a rocker link pinned to the press frame, and a connecting link pinned to the power link and to the press slide. The invention is characterized by a unique power link-rocker link structural interrelationship which enables the foregoing advantages to be obtained. In a preferred arrangement, the power link includes an eccentric having an axis parallel to and offset from the axis of the drive shaft eccentric, and the rocker link is received on the power link eccentric which has an outer periphery extending about the axis of the drive shaft eccentric. The axis of the power link eccentric is quite close to the axis of the drive shaft eccentric and the pivot axis between the rocker link and press frame is above the drive shaft axis. Further in accordance with the preferred arrangement, the pivot axis between the rocker link and press frame is on the opposite side of the slide path from the axis between the rocker link and power link. Rotation of the drive shaft oscillates the power link eccentric axis along an arcuate path determined by the rocker link, and the rocker link constrains displacement of the power link to impart reciprocating movement to the press slide. The close relationship of the eccentric axes and the location of the rocker link axis relative to the slide path provide for pivotal and oscillating movements of the power link and rocker link to be minimal, enables a slide stroke five or more times longer than the throw of the eccentric drive shaft, and enables the desired high velocity return and approach movements of the slide and velocity slow down through the work stroke. The arrangement further enables a mechanical advantage of approximately 5:1.

It is accordingly an outstanding object of the present invention to provide an improved press drive mechanism of the character including an eccentric shaft, power link, rocker link and connecting link members cooperable to impart reciprocating movement to a press slide in response to rotation of the shaft.

Another object is the provision of a press drive mechanism of the foregoing character which enables obtaining larger slide stroke to eccentric throw ratios than heretofore possible and desirably high work stroke to total stroke ratios.

Yet another object is the provision of a press drive mechanism of the foregoing character which enables a reduction in the acceleration forces between component parts of the drive mechanism in comparison with previous drive mechanisms.

A further object is the provision of a press drive mechanism of the foregoing character in which the mass of the mechanism for a given press is less than that required with previous mechanisms for the same size press.

Still a further object is the provision of a press drive mechanism of the foregoing character which is economical to produce and maintain and which enables use of a more conventional and thus more economical crown design with respect to the press frame.

Still another object is the provision of a press drive mechanism of the foregoing character in which a power link member includes an eccentric receiving the rocker link member and having an axis parallel to and closely spaced from the axis of the drive shaft eccentric.

Another object is the provision of a press drive mechanism of the foregoing character which enables minimizing bending loads on the component parts of the mechanism and improved distribution of forces from the drive mechanism to the press frame.

The foregoing objects, and others, will in part be obvious and in part pointed out more fully hereinafter in conjunction with the written description of preferred embodiments of the invention shown in the accompanying drawings in which.

Figure 1:
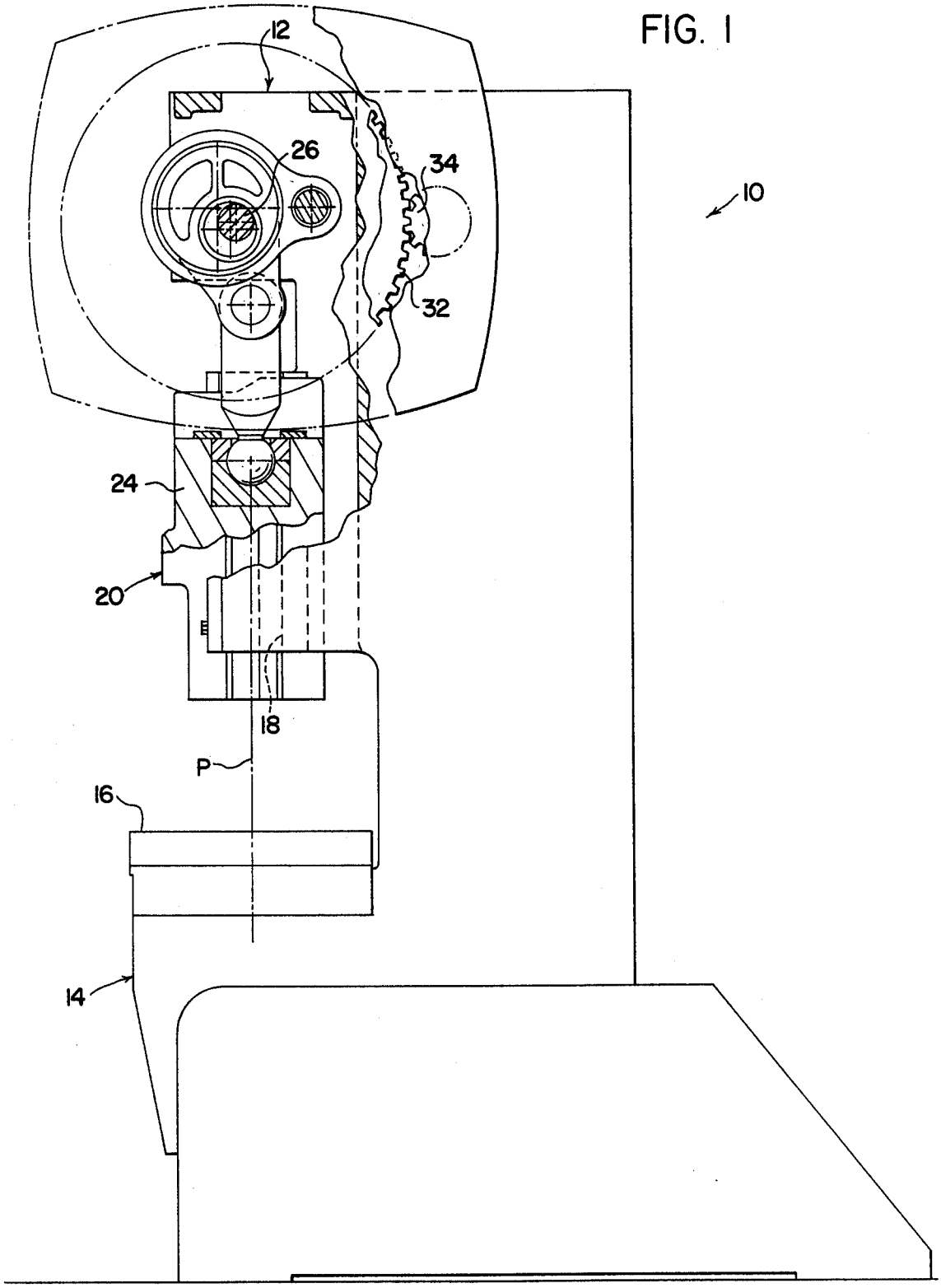
FIG. 1 is a side elevation view, partially in section, of a press incorporating a drive mechanism in accordance with the present invention.

Referring now in greater detail to the drawings wherein the showings are for the purpose of illustrating a preferred embodiment of the invention only and not for the purpose of limiting the invention, FIG. 1 illustrates a press 10 having a frame structure including a crown portion 12 and a base portion 14 providing a bed 16. The press frame is provided with gibbing 18 which supports a slide assembly 20 for reciprocating movement along a linear slide path P toward and away from bed 16. Slide assembly 20 includes a slide member 24 interconnected as described hereinafter with the drive mechanism of the press and, as is well known, the slide assembly and press bed are adapted to support cooperable tooling which operates during reciprocation of the slide assembly to perform work on a workpiece interposed therebetween.

Figure 2:
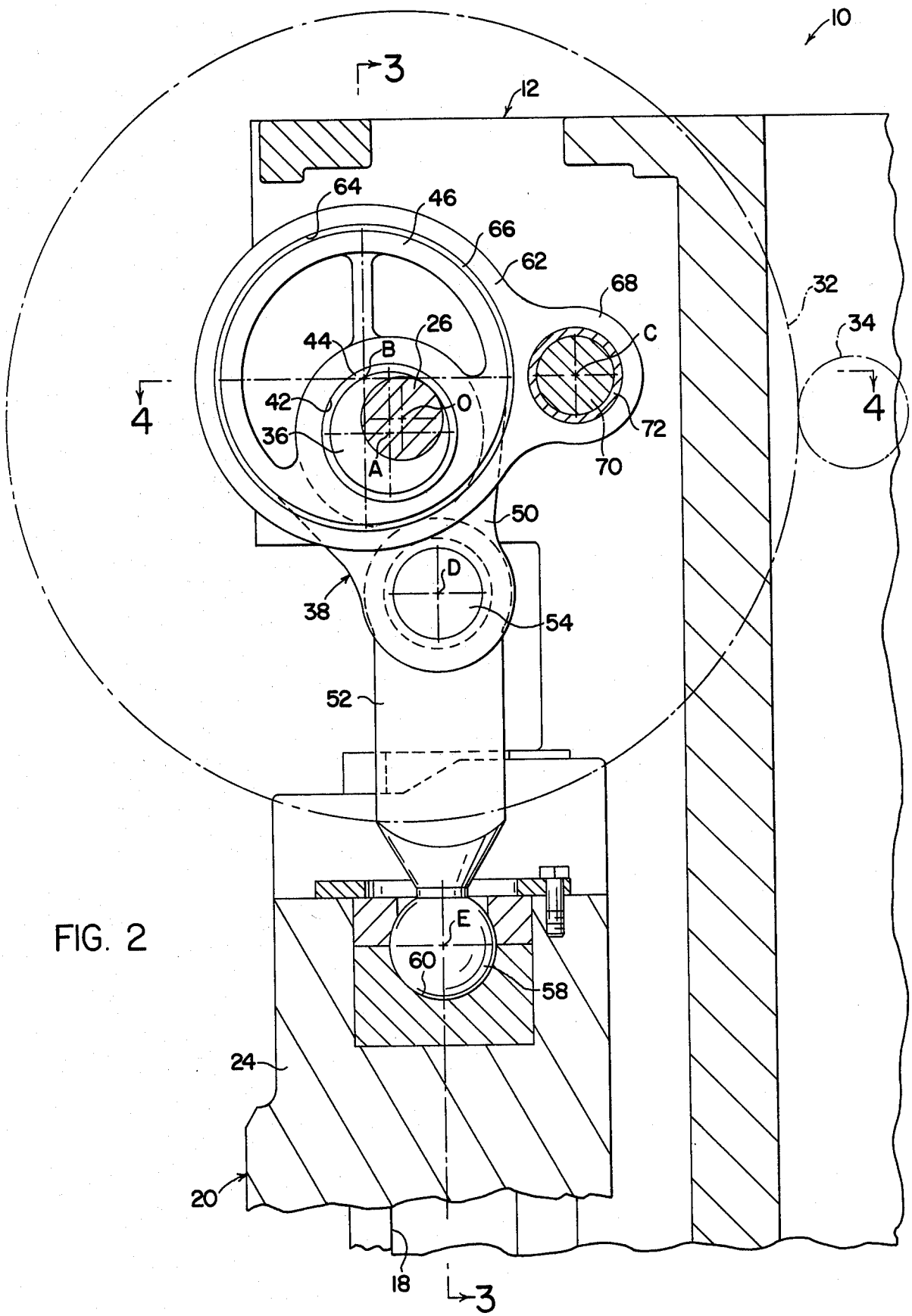
FIG. 2 is a detailed side elevation view, in section, of the component parts of the drive mechanism shown in FIG. 1.
Figure 3:
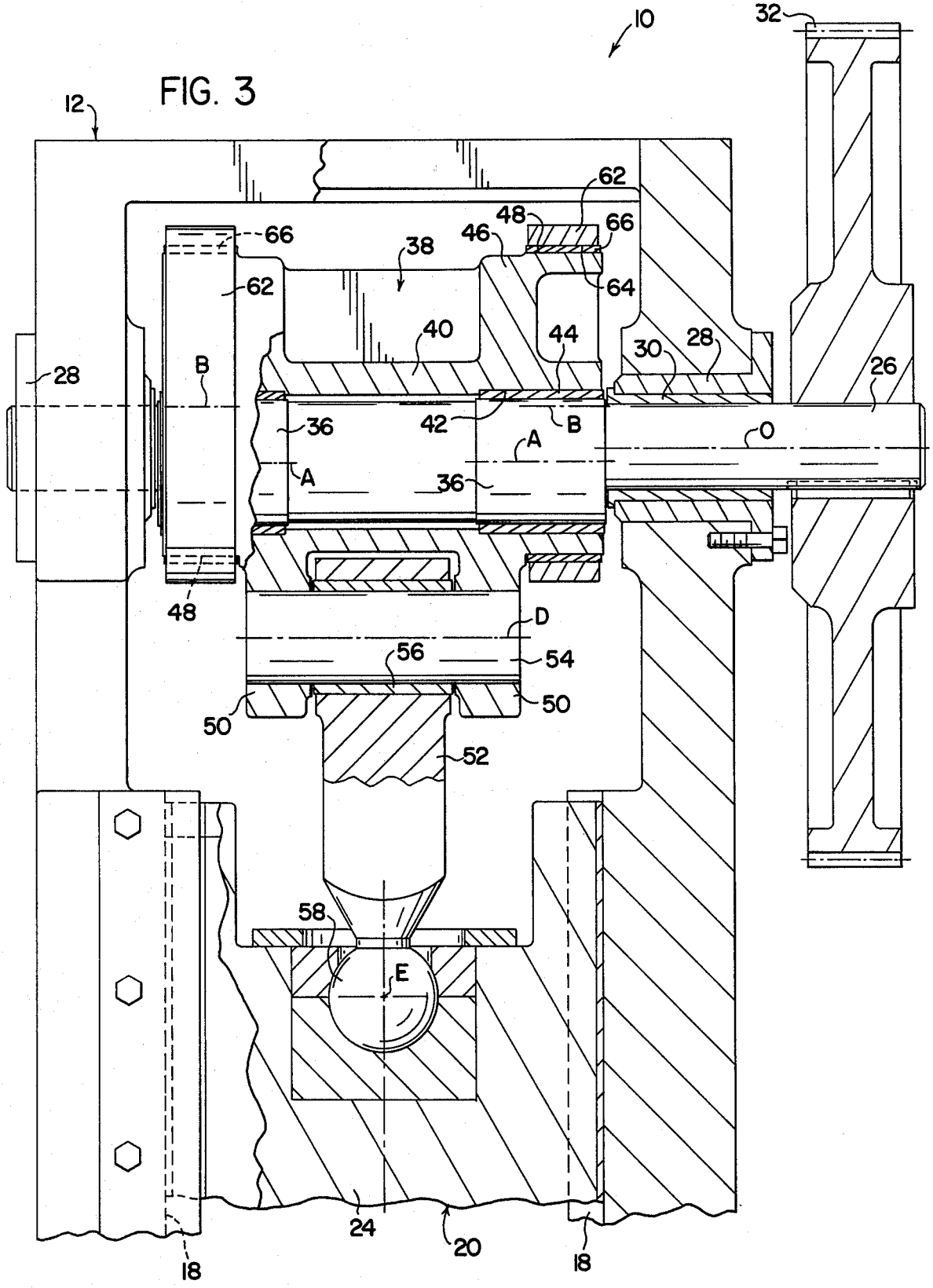
FIG. 3 is a sectional elevation view of the drive mechanism taken along line 3—3 in FIG. 2.
Figure 4:
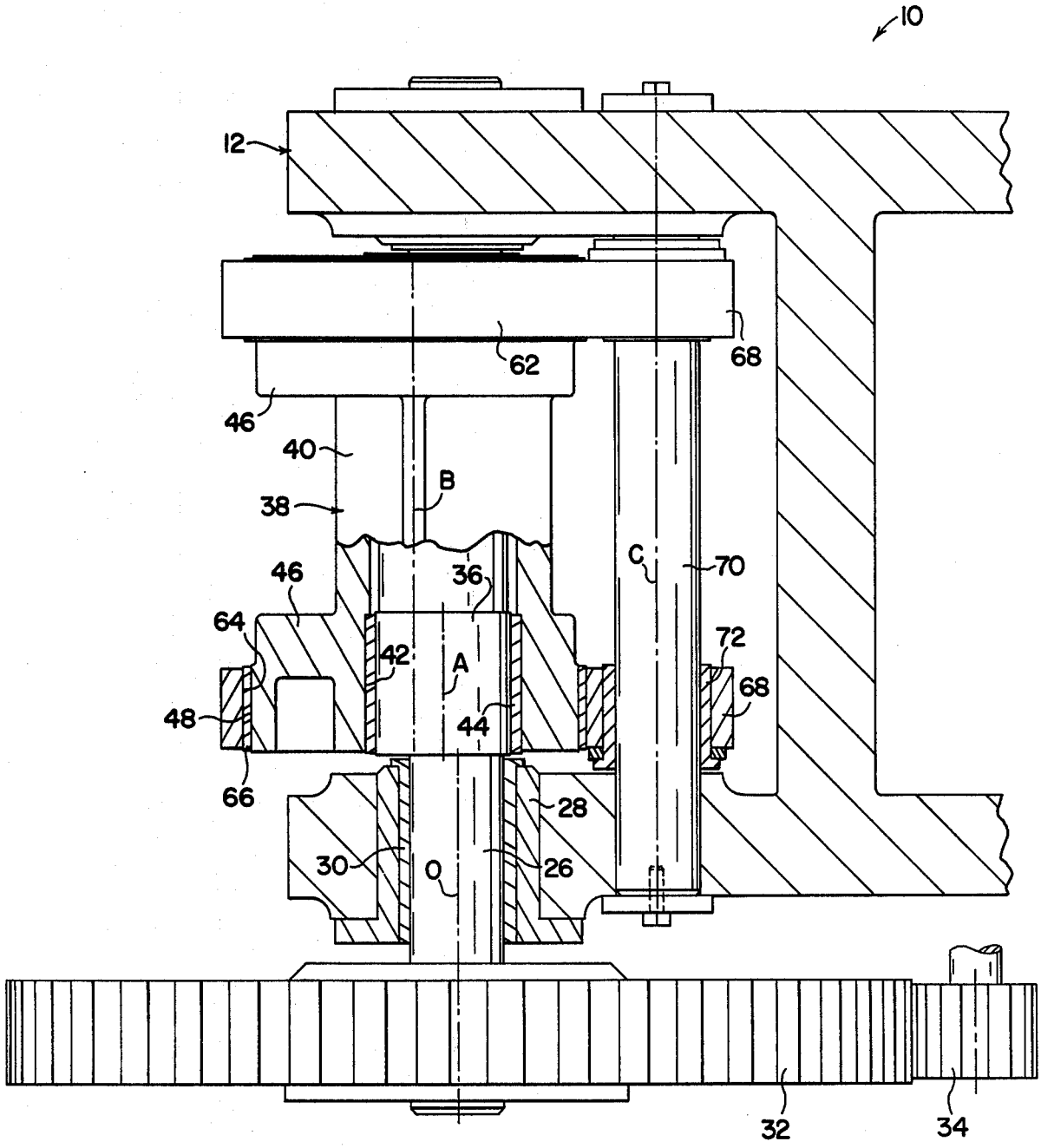
FIG. 4 is a sectional plan view of the drive mechanism taken along line 4—4 in FIG. 2.

As best seen in FIGS. 2–4 of the drawing, the press drive mechanism includes an input or drive shaft 26 extending between the sides of the press frame and supported for rotation relative to the press frame about a shaft axis O. More particularly, opposite sides of the press frame are provided with openings therethrough receiving corresponding shaft mounting sleeves 28 and shaft bearing sleeves 30 which receive the ends of shaft 26 and support the shaft for rotation. In the embodiment illustrated, one end of shaft 26 is provided with a gear 32 keyed or otherwise secured thereto and adapted to be rotated such as by a motor driven pinion 34, as shown in FIG. 1, thus to rotate input shaft 26.

Input shaft 26 includes a pair of axially spaced apart eccentrics 36 having a circular outer periphery and a common axis A which is parallel to and laterally offset from drive shaft axis O. The drive mechanism further includes a power link member 38 including a hub portion 40 surrounding the drive shaft and provided with circular openings 42 receiving a corresponding one of the shaft eccentrics 36. Sleeve bushings 44 are received in openings 42, whereby power link member 38 is supported for pivotal movement relative to drive shaft 26 about axis A of eccentrics 36. Power link member 38 further includes a pair of axially spaced apart eccentrics 46 at opposite ends of hub portion 40 and each of which eccentrics 46 includes a circular outer periphery 48 surrounding a corresponding one of the drive shaft eccentrics 36. The circular outer peripheries 48 of eccentrics 46 have a common axis B which is parallel to and laterally offset from eccentric axis A and drive shaft axis O.

Power link member 38 further includes a pair of arms 50 which extend radially from hub portion 40 in axially spaced apart relationship with respect to one another. The upper end of a connecting link member 52 of the drive mechanism is received between arms 50 and is pivotally interconnected therewith by means of a pin 54 extending through aligned openings in arms 50 and the upper end of connecting link 52. Pin 54 is suitably secured to arms 50, and a suitable bearing sleeve 56 is interposed between pin 54 and the opening through connecting link 52 to enhance pivotal interengagement therebetween. Connecting link 52 is thus pivotal relative to power link 38 about pin axis D which is parallel to axes O, A and B. In the embodiment shown, the lower end of connecting link 52 is provided with a spherical ball 58 received in a spherical socket 60 in slide member 24, thus to interengage the connecting link and slide member for relative pivotal movement about an axis E.

The drive mechanism further includes a pair of rocker link members 62 each including a circular opening 64 therethrough receiving a corresponding one of the power link eccentrics 46 therein. A sleeve bearing 66 is interposed between surfaces 48 of eccentrics 46 and the inner surfaces of openings 64 to enhance pivotal interengagement between roller link member 62 and power link member 38, and it will be appreciated that the latter members are relatively pivotal about axis B. Rocker link members 62 each include an arm 68 extending radially with respect to axis B, and arms 68 are apertured to receive a common pivot pin 70 having its opposite ends suitably connected to the press frame, whereby the rocker link members are pivotal relative to the press frame about axis C of pin 70. Suitable sleeve bearings 72 are interposed between pin 70 and the openings in link arms 68 to enhance pivotal interengagement therebetween.

Figure 5:
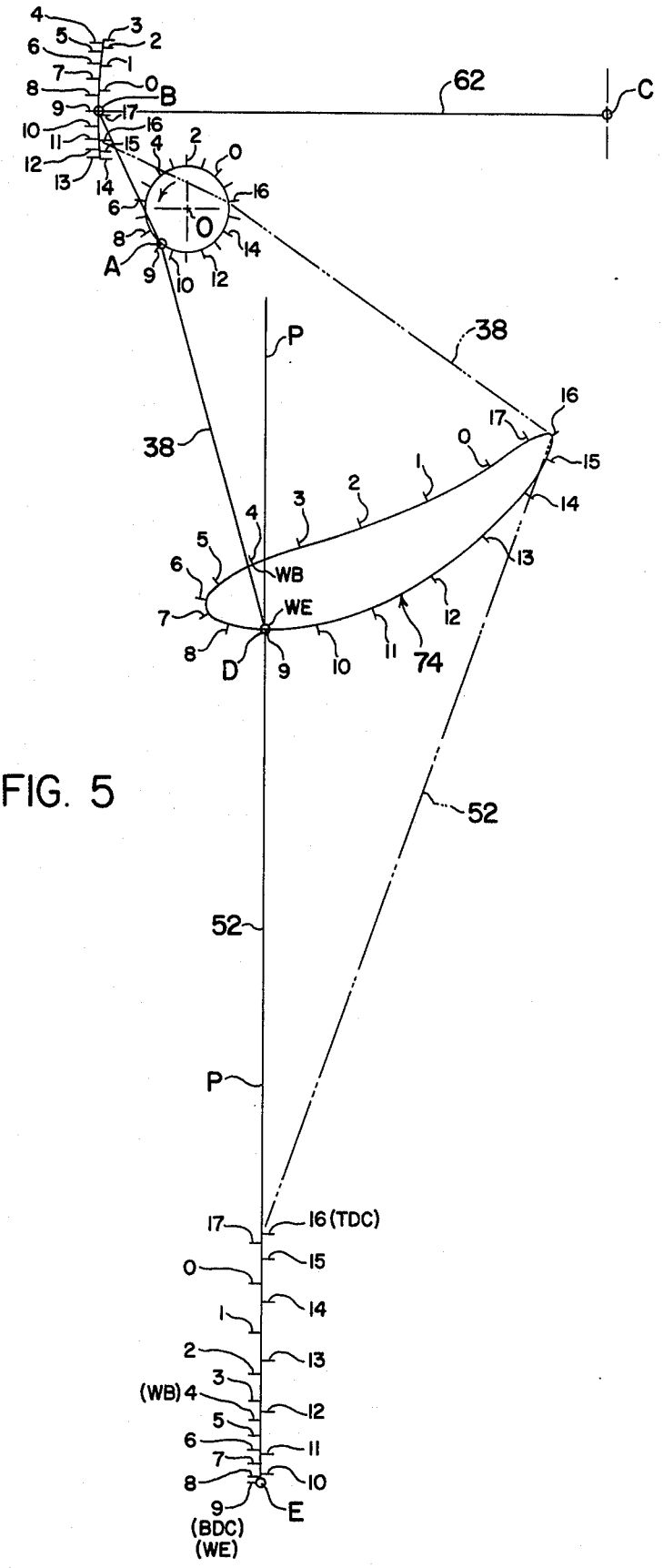
FIG. 5 is a diagrammatic illustration of the drive mechanism showing the position of the press slide and the coupler curve generated during one complete revolution of the drive shaft.

It will be appreciated from the foregoing description that shaft axis O and pin axis C are fixed relative to the press frame. In response to rotation of drive shaft 26, as diagrammatically illustrated in FIG. 5, axis A of eccentrics 26 rotates about axis O whereby eccentrics 26 oscillate axis B of the power link member eccentrics 46 along an arcuate path having a radius defined by the distance between axes B and C. During such rotation of drive shaft 26 and oscillation of axis B the rocker link members 62 constrain pivotal movement of power link member 38 about axis A for axis D between power link member 38 and connecting link member 52 to generate a coupler path 74 as shown in FIG. 5. Since the press slide moves along linear path P during reciprocation thereof, axis E moves along the same path whereby its position along the path is representative of the slide position between the top dead center and bottom dead center positions thereof relative to the press bed. The distance between eccentric axes A and B is fixed as is the distance between axes A and D and the angle BAD.

The embodiment herein illustrated and described is a sixty ton inclinable press in which the slide has a total stroke from top dead center to bottom dead center of four inches and a working stroke beginning one inch above bottom dead center. The component parts of the drive mechanism in the embodiment described have the following dimensions and dimensional relationships. Drive shaft axis O is laterally spaced from slide path P 1.318 inches and the first eccentric axis A is offset from axis O 0.6837 inch. First eccentric axis A and second eccentric axis B are spaced apart 2.325 inches, and first eccentric axis A and axis D between power link 38 and connecting link 52 are spaced apart 6.495 inches. Axes B, A and D define the corners of a triangle in which the angle BAD is approximately 170°. Connecting link 52 has a length between axes D and E of 13.674 inches, and rocker link 62 has a length between axes B and C of 8.299 inches. Axis C is spaced above drive shaft axis O 1.571 inches and is laterally spaced from slide path P on the opposite side of the slide path from axis O a distance of 5.533 inches.

To more fully appreciate the operation of the press, reference is made to FIG. 5 which is a schematic representation of the drive mechanism proportioned in accordance with the foregoing dimensions and dimensional relationships between the components of the mechanism. Referring now to FIG. 5, drive shaft 26 is rotated counterclockwise to rotate first eccentric axis A counterclockwise in a circular path about drive shaft axis O. The path of axis A is illustrated in increments of 20° starting at a reference point o. As explained hereinafter, rotation of drive shaft 26 results in displacement of axis D between power link 38 and connecting link 52 along a path generating a coupler curve 74, and movement of axis D along the coupler curve is illustrated in increments corresponding to the 20° increments of rotation of eccentric axis A. Further, axis E between connecting link 52 and slide member 24 corresponds to displacement of the slide assembly along slide path P, whereby axis E reciprocates along the slide path in response to movement of axis D along coupler curve 74. Accordingly, the reciprocating movement of axis E through the full stroke of the slide assembly is dictated by the coupler curve and is illustrated in increments corresponding to the 20° increments of rotation of eccentric axis A. The upper or top dead center and lower or bottom dead center positions of the slide assembly are indicated TDC and BDC, respectively, and the beginning and ending points of the work stroke portion of the total stroke of the slide are identified WB and WE, respectively, on the coupler curve and on the slide path.

It will be further appreciated from FIG. 5 that, in response to counterclockwise rotation of drive shaft 26, the first eccentric 36 represented by axis A displaces the power link eccentric 46 represented by axis B along an arcuate path 76 relative to fixed axis C and which path has a radius corresponding to the dimension B-C. Accordingly, the positions of axis B along arcuate path 76 in response to rotation of the drive shaft are illustrated in increments corresponding to the 20° increments of rotation of eccentric axis A. Displacement of axis B along path 76 provides a corresponding oscillation of rocker link member 62 about axis C, and rocker link member 62 constrains power link member 38 to pivot about first eccentric axis A relative to first eccentric 36, thus moving axis D of the power link so as to define coupler curve 74. As mentioned hereinabove, the B-C of arcuate path 76 is fixed, the distance between axes A and B is fixed, the distance between axes A and D is fixed and the angle BAD is fixed. Thus, for any point representing an increment of rotation of axis A about drive shaft axis O, the corresponding position of axis D can be determined by connecting the point A and the corresponding point B on path 76, and then measuring the distance A-D along a line extending from point A at the angle BAD.

As will be seen from FIG. 5, the slide reaches the bottom dead center position at about 180° of rotation of the drive shaft and reaches the top dead center position at about 320° of rotation. As mentioned hereinabove, the press has a 1 inch work stroke and, accordingly, the slide reaches the beginning of the work stroke WB at about 80° of drive shaft rotation and reaches the bottom of the work stroke WB when the slide reaches the bottom dead center position at about 180° of rotation. Thus, the drive shaft rotates about 100° during the work stroke. Movement of axes D and E respectively along the coupler curve and slide path from the bottom dead center position to the point WB corresponding to the beginning of the next working stroke defines the return portion of the work stroke and the return and advance portions of the total stroke of the slide.

The spacing of the indicator points along the coupler curve is indicative of the velocity of axis D during one complete cycle of rotation of drive shaft 26. Similarly, the spacing of the indicator points along slide path P are indicative of the velocity of axis E and thus the press slide during one total stroke thereof. Drive shaft 26 is rotated at constant speed, and larger spacings between two given indicator points is indicative of higher slide velocity than smaller spacings.

With the foregoing in mind, it will be seen from FIG. 5 that axis E moves downwardly from the top dead center position thereof toward the beginning of the work stroke WB at a relatively high velocity which decreases as axis E approaches and enters the work stroke. Upon entering the work stroke the velocity of axis E is considerably reduced and continues to be reduced as axis E moves through the bottom dead center position. After passing through the bottom dead center position the velocity of axis E is again increased considerably as it moves upwardly toward the top dead center position.

Figure 6:
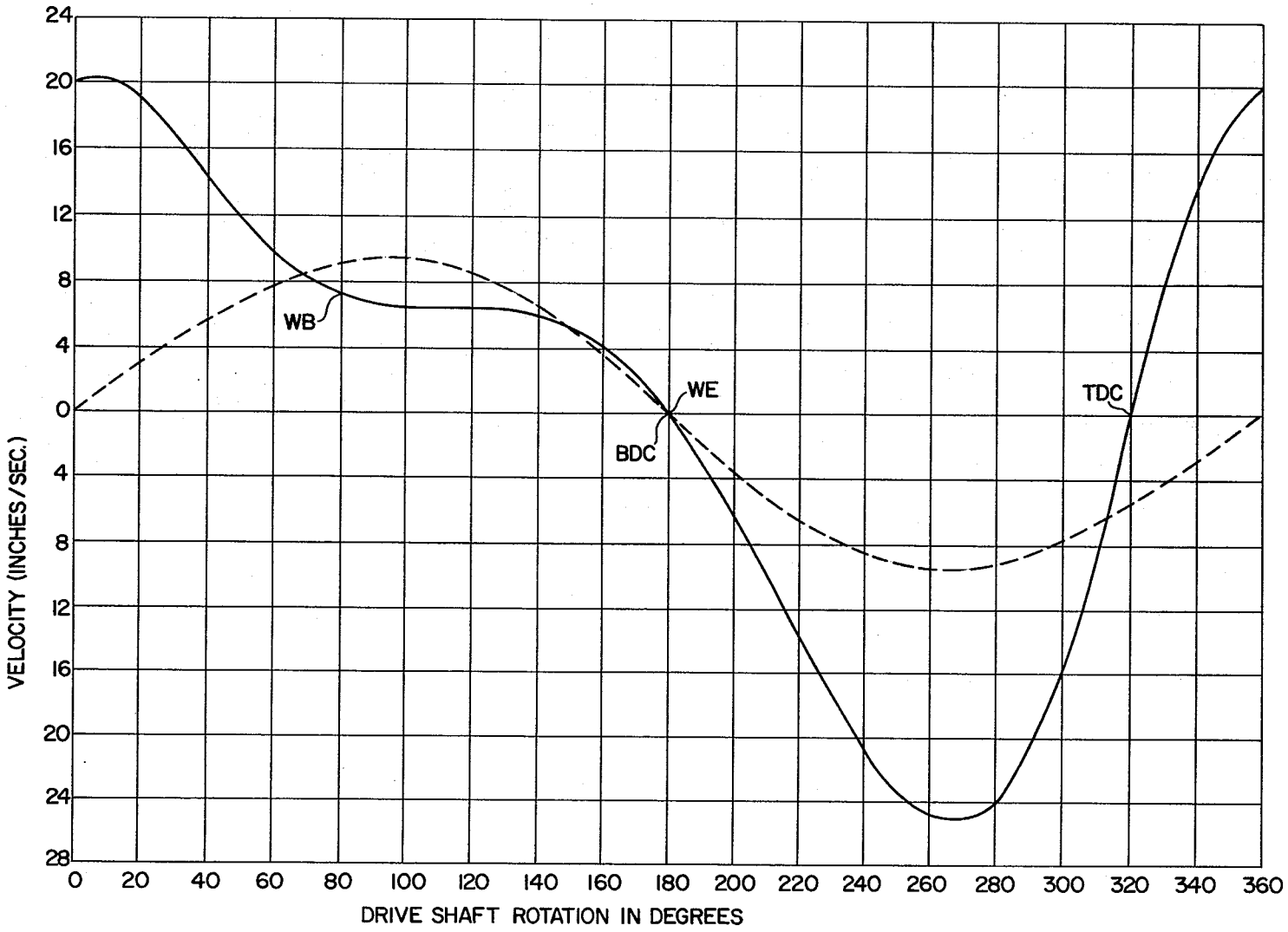
FIG. 6 is a graph illustrating slide velocity during one complete revolution of the drive shaft; and, FIG. 7 is a graph showing slide displacement during one complete revolution of the drive shaft.
Figure 7:
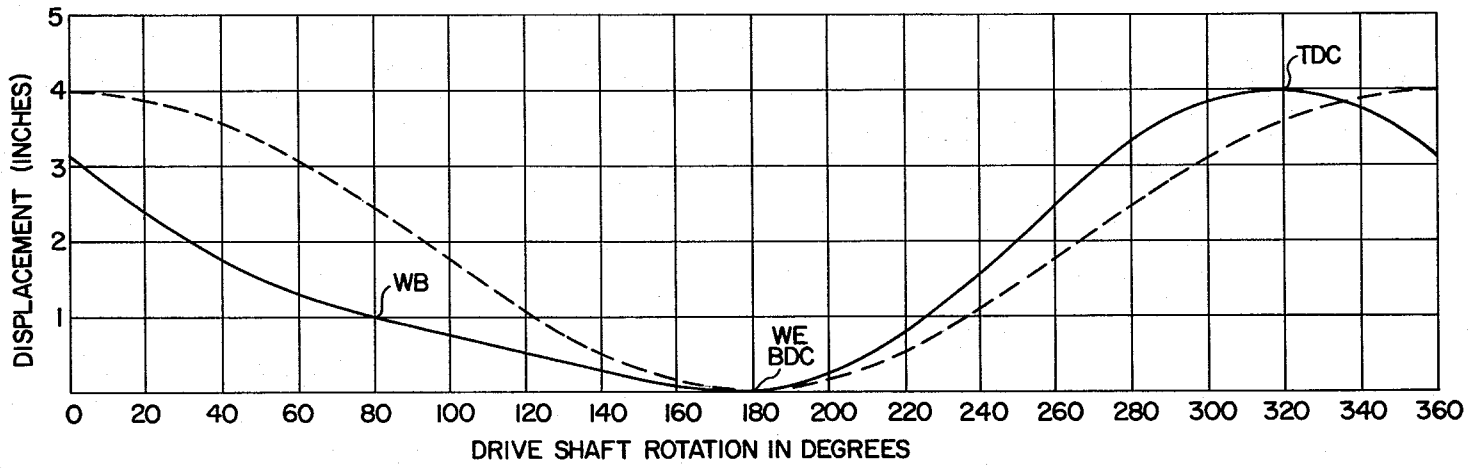

The slide velocity during the various portions of the total stroke thereof is shown graphically in FIG. 6 by the solid line curve and with the press operating at a rate of ninety strokes per minute. The broken line curve in FIG. 6 illustrates the velocity of a conventional crank-driven press of similar size operating at a rate of forty-five strokes per minute. The displacement of the slide is shown graphically in FIG. 7 by the solid line curve and in comparison with the displacement of the slide of a conventional crank-driven press which is shown by the broken line curve. With reference to the description of FIG. 5, it will be seen from FIGS. 6 and 7 that the beginning of the work stroke of the slide is at the point corresponding to 80° of rotation of the drive shaft and that at this point the velocity is decreasing and that the slide is one inch above the bottom dead center position thereof. In comparison, the slide of a conventional crank-driven press is increasing at this point and does not reach an acceptable workpiece forming velocity until about 135° of crankshaft rotation, at which point the slide is about ½ inch above bottom dead center. Accordingly, the crank driven press shown would have a work stroke to total stroke ratio of about 1:8 whereas the press herein described has a ratio of 1:4. With further regard to FIG. 6, it will be seen that the slide of the press herein described has a much higher return and approach velocity than that of a conventional crank-driven press of corresponding size. The ability to achieve a slide velocity slow down during the work stroke to an acceptable velocity for performing work on a workpiece enables the press described herein to operate at a rate twice that of the conventional crank-driven press.

It will be appreciated as mentioned herein that the ability to obtain a slow down in slide velocity during the work stroke enables a given press to be operated at a higher stroke rate than a conventional crank-driven press. Slide velocity is the characteristic of primary concern in connection with the work stroke in than that too high a slide velocity is detrimental to tool life and the quality of the work being performed. Further, as mentioned herein, other press drive arrangements have been provided which enable achieving a desired slow down of the slide during the work stroke so as to enable increasing the rate of operation of the press without detriment to tool life or work quality. Such previous drive mechanisms, and that according to the present invention, also advantageously enable obtaining a mechanical advantage of about 5:1 with respect to the transmission of the working force through the slide. Advantageously, a press drive mechanism in accordance with the present invention provides all of these characteristics and the resulting improvements in comparison with a conventional crank-driven press and, at the same time, enables obtaining a higher work stroke to total stroke ratio than heretofore possible and longer slide strokes than heretofore possible for a given crankshaft or eccentric drive shaft throw. Additionally, a drive mechanism in accordance with the present invention provides a better distribution of mass within the press frame to improve force distribution, to minimize acceleration forces and to minimize production cost and unit size in comparison with such previous drive mechanisms.

With respect to the foregoing improvements provided in accordance with the present invention, it will be seen that in the embodiment herein illustrated and described the press slide has a four inch total stroke achieved with an eccentric drive shaft having a throw of 0.6837 inch. This provides a drive shaft eccentric to slide stroke ratio of nearly 1:6. Of importance in connection with achieving the foregoing improvements is the location of axis C on a horizontal plane spaced above the horizontal plane of axis O and on the opposite side of the slide path with respect to axis B. Preferably, axis C is located above axis O a distance at least equal to the throw OA of the drive shaft. It is further preferred that axes B and C be located on opposite sides of drive shaft axis O as well as on opposite sides of the slide path. Also of importance is the angle BAD which, preferably, is between 150° to 180°. Still further, while the drive shaft axis O is shown offset to one side of the slide path, the drive shaft axis can be on the slide path or offset to the other side from that shown herein and, if offset, is preferably offset no further than about twice the distance OA.

While considerable emphasis has been placed on the structure of the component parts of the preferred embodiment and the structural interrelationship therebetween, it will be appreciated that many changes can be made with regard to these structures and structural interrelationships and with regard to dimensions of the component parts of the drive mechanism without departing from the principles of the present invention. Accordingly, it is to be distinctly understood that the foregoing descriptive matter is to be interpreted merely as illustrative of the present invention and not as a limitation.

Having thus described the invention, it is claimed:

1. A press comprising, frame means, a slide member supported by said frame means for reciprocation along a linear slide path between upper and lower positions, and means to drive said slide member, said drive means including shaft means supported by said frame means for rotation about a shaft axis transverse to said path, said shaft means including first eccentric means rotatable therewith and having a first axis parallel to and offset with respect to said shaft axis, power link means pivotally received on said first eccentric means and having an end spaced from said shaft axis and said first axis, connecting link means pivotally interconnecting said slide member and said end of said power link means, said power link means including second eccentric means having an outer periphery surrounding said shaft axis and having a second axis parallel and offset with respect to said shaft axis and said first axis, and rocker link means pivotally received on said outer periphery of said second eccentric means and having an end spaced from said second axis and connected to said frame means for pivotal movement about a third axis parallel to said second axis.

2. The press according to claim 1, wherein said upper and lower positions of said slide member are spaced apart a given distance in the direction of said path, and the ratio of the dimension of said first axis offset and said given distance is at least 1:5.

3. The press according to claim 1, wherein the angle between a line through said first and second axes and a line through said first axes and the pivotal connection between said power link means and connecting link means is from about 150° to 180°.

4. The press according to claim 1, wherein said first eccentric means has an outer periphery and said second axis is located adjacent said outer periphery.

5. The press according to claim 1, wherein said third axis lies in a horizontal plane spaced upwardly from the horizontal plane of said shaft axis.

6. A press according to claim 1, wherein said shaft axis is laterally spaced from said slide path.

7. A press according to claim 6, wherein said third axis lies in a horizontal plane spaced upwardly from the horizontal plane of said shaft axis.

8. The press according to claim 1, wherein said shaft axis lies on one side of said slide path and said third axis lies on the opposite side of said slide path.

9. The press according to claim 8, wherein said third axis lies in a horizontal plane spaced upwardly from the horizontal plane of said shaft axis.

10. The press according to claim 8, wherein said second axis is laterally spaced from said slide path on said one side of said path.

11. The press according to claim 9, wherein the angle between a line through said first and second axes and a line through said first axes and the pivotal connection between said power link means and connecting link means is from about 150° to 180°.

12. The press according to claim 11, wherein said third axis lies in a horizontal plane spaced upwardly from the horizontal plane of said shaft axis.

13. A press comprising frame means, a slide member supported by said frame means for reciprocation aong a linear slide path between upper and lower positions, and drive means to reciprocate said slide member, said drive means comprising a shaft supported by said frame means for rotation about a shaft axis transverse to said slide path, said shaft including a first eccentric having a circular periphery surrounding said shaft axis and a first axis parallel to and laterally spaced from said shaft axis, a power link member having a circular opening therethrough receiving said first eccentric for said power link member to be pivotal relative to said first eccentric, said power link member having an end spaced from said circular opening, a connecting link having opposite ends pivotally connected one to said end of said power link member and the other to said slide, said power link member further including a second eccentric having a circular outer periphery surrounding said first eccentric and a second axis parallel to and laterally offset from said first axis and said shaft axis, and a rocker link member having a circular opening therethrough receiving said second eccentric for said rocker link member and power link member to be pivotally interengaged, said rocker link member having an end spaced from said circular opening therethrough and pivotally interconnected with said frame means at a third axis spaced from and parallel to said second axis.

14. The press according to claim 13, wherein said upper and lower positions of said slide member are spaced apart a given distance in the direction of said path and the ratio of the dimension of said first axis offset and said given distance is at least 1:5.

15. The press according to claim 13, wherein the angle between a line through said first and second axes and a line through said first axis and said pivotal connection between said connecting link and power link member is from about 150° to 180°.

16. The press according to claim 13, wherein said third axis is on one side of said slide path and said shaft axis is on the opposite side of said slide path.

17. The press according to claim 16, wherein said shaft axis is below said third axis with respect to the direction between said upper and lower positions of said slide.

18. The press according to claim 17, wherein said second axis is on said opposite side of said slide path.

19. The press according to claim 13, wherein said shaft axis is laterally spaced from said slide path.

20. The press according to claim 19, wherein said shaft axis is spaced from said slide path a distance at least equal to the offset between said shaft axis and said first axis.

21. The press according to claim 20, wherein said third axis is on one side of said slide path and said shaft axis is on the opposite side of said slide path.

22. The press according to claim 21, wherein said shaft axis is below said third axis with respect to the direction between said upper and lower positions of said slide.

23. A press comprising, frame means, a slide member supported by said frame means for reciprocation along a linear slide path between upper and lower positions, and means to drive said slide member, said drive means including shaft means supported by said frame means for rotation about a shaft axis transverse to said path, said shaft means including first eccentric means rotatable therewith and having a first axis parallel to and offset with respect to said shaft axis, power link means pivotally received on said first eccentric means and having an end spaced from said shaft axis and said first axis, connecting link means pivotally interconnecting said slide member and said end of said power link means, said power link means including a second axis parallel and offset with respect to said shaft axis and said first axis, and rocker link means pivotally connected to said power link means at said second axis and to said frame means at a third axis parallel to said second axis, said third axis being above said shaft axis with respect to the direction between said upper and lower positions of said slide, and said second and third axes being on opposite sides of said slide path.

24. The press according to claim 23, wherein said shaft axis is laterally spaced from one side of said slide path and said second axis lies on said one side of said path.

25. The press according to claim 24, wherein said third axis is spaced above said shaft axis a distance at least equal to the offset between said shaft and first axes.

26. The press according to claim 23, wherein the angle between a line through said first and second axes and a line through said first axis and the point of connection between said connecting link means and said power link means is from about 150° to 180°.

27. The press according to claim 26, wherein said upper and lower positions of said slide member are spaced apart a given distance in the direction of said path, and the ratio of the dimension of said first axis offset and said given distance is at least 1:5.

28. The press according to claim 26, wherein said shaft axis is laterally spaced from one side of said slide path and said second axis lies on said one side of said path.

29. The press according to claim 28, wherein said third axis is spaced above said shaft axis a distance at least equal to the offset between said shaft and first axes.

30. The press according to claim 23, wherein said upper and lower positions of said slide member are spaced apart a given distance in the direction of said path, and the ratio of the dimension of said first axis offset and said given distance is at least 1:5.

31. The press according to claim 30, wherein said shaft axis is laterally spaced from one side of said slide path and said second axis lies on said one side of said path.

32. The press according to claim 31, wherein said third axis is spaced above said shaft axis a distance at least equal to the offset between said shaft and first axes.

33. The press according to claim 32, wherein the angle between a line through said first and second axes and a line through said first axis and the point of connection between said connecting link means and said power link means is from about 150° to 180°.

* * * * *